US007602349B2

(12) United States Patent
Hentosh et al.

(10) Patent No.: US 7,602,349 B2
(45) Date of Patent: Oct. 13, 2009

(54) SYSTEM OF STOWING AND DEPLOYING MULTIPLE PHASED ARRAYS OR COMBINATIONS OF ARRAYS AND REFLECTORS

(75) Inventors: David J. Hentosh, Yardley, PA (US); Michael J. Edridge, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 466 days.

(21) Appl. No.: 11/653,912

(22) Filed: Jan. 17, 2007

(65) Prior Publication Data

US 2007/0200780 A1 Aug. 30, 2007

Related U.S. Application Data

(60) Provisional application No. 60/776,200, filed on Feb. 24, 2006.

(51) Int. Cl.
*H01Q 3/02* (2006.01)

(52) U.S. Cl. ..... 343/882; 343/DIG. 2; 244/172.6

(58) Field of Classification Search ..... 343/757, 343/840, 853, 880–882, 915, 916, DIG. 2; 244/172.6

See application file for complete search history.

(56) References Cited

U.S. PATENT DOCUMENTS 3,699,581 A 10/1972 Hall et al.
5,520,747 A 5/1996 Marks
6,124,835 A 9/2000 Nguyen et al.
6,448,940 B1 * 9/2002 Chiang ..... 343/882
6,859,188 B1 2/2005 Matthews
7,180,470 B1 * 2/2007 Hentosh ..... 343/882
2004/0173726 A1 9/2004 Mercadel et al.
2005/0023415 A1 2/2005 Walker et al.
2005/0146473 A1 7/2005 Stoyanov

* cited by examiner

*Primary Examiner*—Michael C Wimer
(74) *Attorney, Agent, or Firm*—McDermott Will & Emery LLP

(57) ABSTRACT

A spacecraft is provided that includes a spacecraft body, a phased array coupled to a side of the spacecraft body by a first deployment couple, and a reflector coupled to the side of the spacecraft body by a second deployment couple. The first and second deployment couples are configured to permit stowing the reflector and the phased array parallel to the side of the spacecraft body. The reflector and the phased array share a common launch restraint mounting point on the side of the spacecraft body. A spacecraft is also provided that includes a spacecraft body, a mounting platform coupled to a side of the spacecraft body by a deployment couple, and a plurality of phased array assemblies. Each phased array assembly has a face with elements, and is coupled to the mounting platform by a gimbal. The deployment couple and the gimbals are configured to permit stowing the phased array assemblies parallel to the side of the spacecraft body and with the face of each phased array assembly oriented in a first direction. The phased array assemblies share a common launch restraint mounting point on the side of the spacecraft body.

21 Claims, 6 Drawing Sheets

SYSTEM OF STOWING AND DEPLOYING MULTIPLE PHASED ARRAYS OR COMBINATIONS OF ARRAYS AND REFLECTORS

CROSS-REFERENCE TO RELATED APPLICATION

The present application claims the benefit of priority under 35 U.S.C. §119 from U.S. Provisional Patent Application Ser. No. 60/776,200 entitled "SYSTEM OF STOWING AND DEPLOYING MULTIPLE PHASED ARRAYS OR COMBINATIONS OF ARRAYS AND REFLECTORS," filed on Feb. 24, 2006, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to the stowage and deployment of spacecraft elements and, in particular, relates to the stowage and deployment of multiple phased arrays or combinations of phased arrays and reflectors.

BACKGROUND OF THE INVENTION

One of the problems of stowing and deploying both phased arrays and antenna reflectors on the same spacecraft is the mass imbalance created by stowing an array on one side and a reflector on the other. If one side of a spacecraft contains reflectors and the other side phased arrays, the side-to-side center of gravity offset from the spacecraft center axis may lie well outside the limits prescribed by launch vehicle manuals. On-orbit control of the spacecraft may also become troublesome.

Additional problems are encountered when multiple phased arrays or phased array assemblies are provided on a single spacecraft. The mass and size of the spacecraft makes it increasingly difficult to support, deploy, and steer. Moreover, in systems in which each phased array or phased array assembly is provided with its own launch restraint system or tie downs, the increased mass of the launch restraints and launch restraint severing systems will further impact the useful payload of the spacecraft.

SUMMARY OF THE INVENTION

The present invention solves the foregoing problems by providing a stowage system that allows the packaging of one or more phased arrays and reflectors on the East and West sides of a spacecraft in order to distribute the mass of the spacecraft in a more symmetrical manner. This stowage system more efficiently uses the available volume in a launch vehicle and allows phased arrays and reflectors to have their own deployment, retention, and pointing systems, while requiring fewer common launch restraint systems.

According to one embodiment of the present invention, a spacecraft comprises a spacecraft body, a first phased array coupled to a first side of the spacecraft body, a first reflector coupled to the first side of the spacecraft body and a first deployment couple disposed between the first phased array and the first side of the spacecraft body, coupled to the first phased array and the first side of the spacecraft body, and configured to permit stowing the first phased array parallel to the first side of the spacecraft body. The spacecraft further comprises a second deployment couple disposed between the first reflector and the first side of the spacecraft body, coupled to the first reflector and the first side of the spacecraft body, and configured to permit stowing the first reflector parallel to the first side of the spacecraft body. The spacecraft further comprises a first common launch restraint system configured to secure the first phased array and the first reflector to the first side of the spacecraft body using at least one common launch restraint mounting point.

According to another embodiment of the present invention, a spacecraft comprises a spacecraft body, a first mounting platform coupled to a first side of the spacecraft body, a first deployment couple disposed between the first mounting platform and the first side of the spacecraft body and coupled to the first mounting platform and the first side of the spacecraft body, and a first plurality of phased array assemblies. Each of the first plurality of phased array assemblies has a face with a plurality of elements, and each of the first plurality of phased array assemblies is coupled to the first mounting platform by a gimbal. The spacecraft further comprises a first common launch restraint system configured to secure the first plurality of phased array assemblies to the first side of the spacecraft body using at least one common launch restraint mounting point. The first deployment couple and the first plurality of gimbals are configured to permit stowing the first plurality of phased array assemblies parallel to the first side of the spacecraft body and with the face of each of the first plurality of phased array assemblies oriented in a first direction.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Deployable phased arrays and launch restraint subsystems are designed to increase the flexibility, configurability and capability of modem satellites. In this regard, the stowed state is a state in which launch restraints are restraining the phased arrays or phased array assemblies in place for transport, and the deployment couples are in a volume-minimizing, retracted position. The deployed state is a state in which the launch restraints have been removed, and the phased arrays or phased array assemblies have been moved from the stowed position and oriented in their operational locations by fully articulating the deployment couples. A transitory deploying state in between the stowed state and the deployed state is also contemplated, but illustration of this state is not necessary for the purpose of understanding the features of the present invention.

Figure 1B:
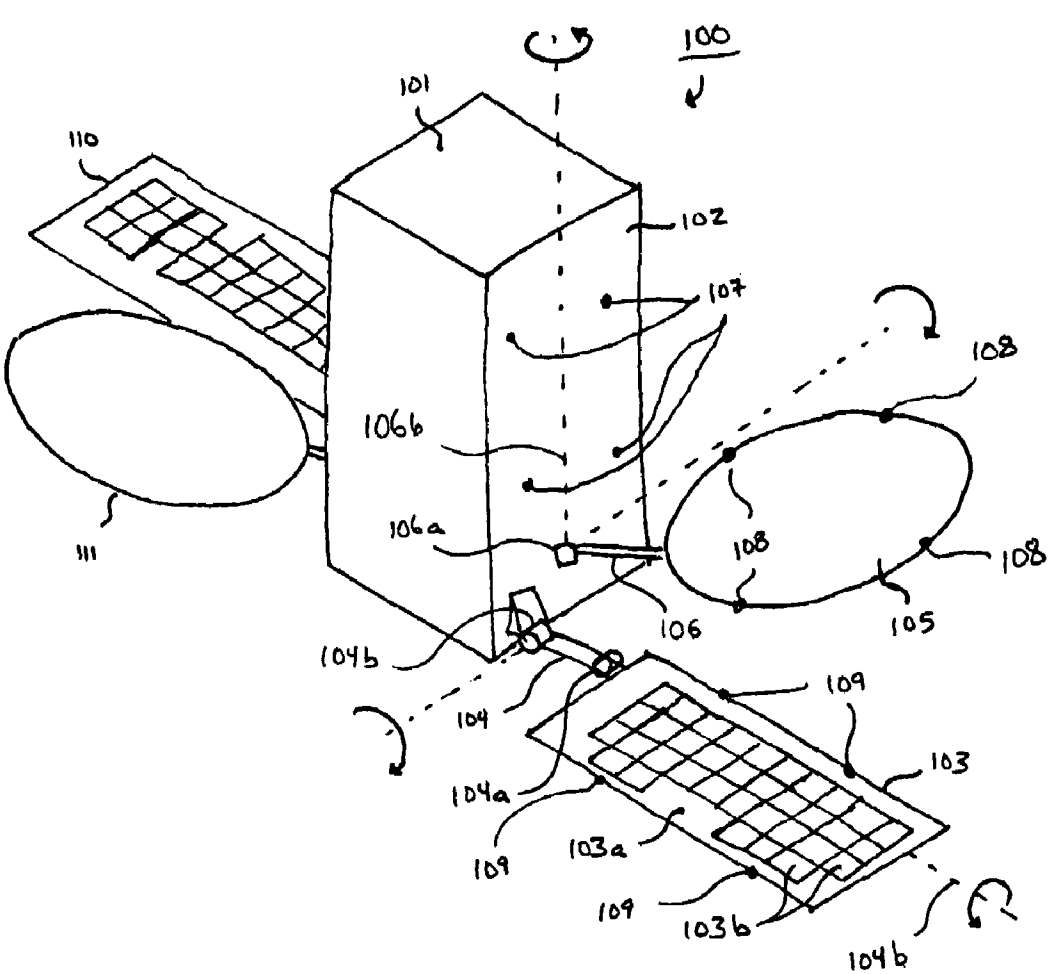
FIGS. 1A and 1B illustrate stowed and deployed states of a spacecraft according to one embodiment of the present invention.
Figure 1A:
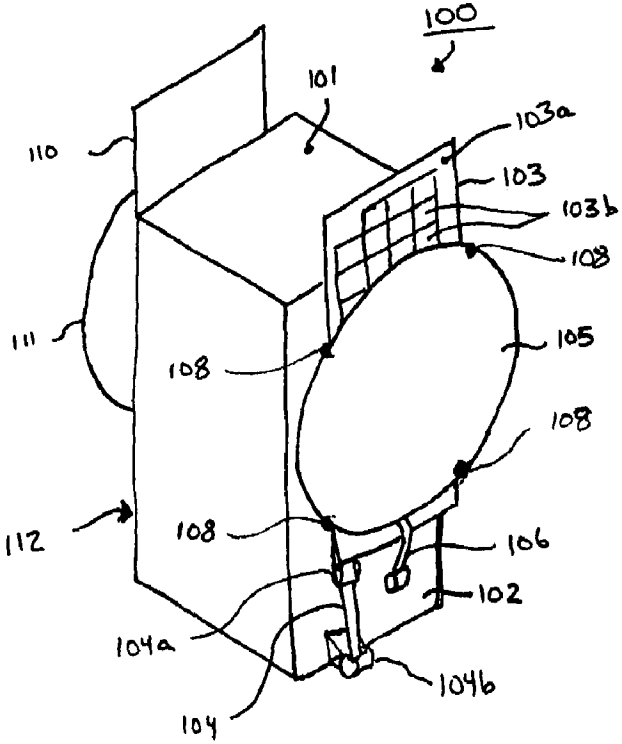

FIG. 1A illustrates a spacecraft according to one embodiment of the present invention, in which a reflector and a phased array are stowed with a common launch restraint mounting point on the same side of the spacecraft. Spacecraft 100 includes spacecraft body 101, which has a side 102. Coupled parallel to side 102 of spacecraft body 101 (i.e., in a stowed position) by a deployment couple 104 is a phased array 103. Phased array 103 has a face 103*a* on which are disposed a number of elements 103*b*. Face 103*a* is oriented facing away from side 102, to protect elements 103*b* from being damaged during launch by side 102. Also coupled parallel to side 102 of spacecraft body 101 by another deployment couple 106 is a reflector 105. In the present exemplary embodiment, deployment couple 104 includes both a 1-axis hinge 104*b* and a 2-axis primary deployment gimbal 104*a*, while deployment couple 106 includes a 2-axis gimbal 106*a*. Four launch restraint locations 108 are provided in reflector 105 for securing reflector to side 102 of spacecraft body 101 with a launch restraint system (not illustrated). Spacecraft 100 further includes another side 112 opposite side 102, to which are coupled another phased array 110 and another reflector 111. Phased array 110 and reflector 111 are coupled to side 112 in a similar manner to that in which phased array 103 and reflector 105 are coupled to side 102.

Turning to FIG. 1B, spacecraft 100 is illustrated with reflector 105 and phased array 103 in a deployed state. As can be seen with reference to FIG. 1B, 2-axis primary deployment gimbal 104*a* which permits phased array 103 to rotate about an axis 104*b* of deployment couple 104. Primary deployment gimbal 104*a* permits phased array 103 to deploy with its face 103*a* and elements 103*b* pointing up, by rotating phased array 103 through 180° around axis 104*b*. As can also be seen with reference to FIG. 1B, deployment couple 106 includes a 2-axis gimbal 106*a* configured to permit reflector 105 to be deployed in the same plane as phased array 103, but with a different axis of orientation (e.g., by rotating reflector 105 around axis 106*b*).

In FIG. 1B, the common launch restraint mounting points 107 which reflector 105 and phased array 103 share can be seen on side 102 of spacecraft body 101. Also visible are the launch restraint locations 109 provided in phased array 103 for securing phased array 103 to side 102 of spacecraft body 101 using a launch restraint system. Using the enhanced antenna stowage and deployment system according to the embodiment of present invention illustrated in FIGS. 1A and 1B, the co-location and consolidation of launch restraints reduces the weight and volume of spacecraft 100 by reducing the number of necessary launch restraints and launch restraint severing mechanisms, thereby increasing overall mission capabilities.

While in the foregoing exemplary embodiment, reflector 105 has been shown stowed on top of phased array 103, the scope of the present invention is not limited to such an arrangement. Rather, as will be apparent to one of skill in the art, the present invention has application to arrangements in which a phased array is stowed on top of a reflector, or arrangements in which reflectors and phased arrays are stacked in any order.

Similarly, while the foregoing exemplary embodiment, exactly four common launch restraint mounting points 107 have been illustrated on side 102 of spacecraft body 101, the scope of the present invention is not limited to such an arrangement. Rather, as will be apparent to one of skill in the art, the present invention has application to arrangements in which any number of common launch restraints greater than or equal to one are shared on a side of a spacecraft body.

Since the purpose of deployment couples 104 and 106 is to deploy the phased array and reflector, respectively, the appropriate size, tolerances, arrangement, type and design of deployment couples 104 and 106 depends on several factors, including aperture size, number and type of phased array elements or reflectors on each assembly, spacecraft size, type, design, or material, or any number of other factors. As such, in certain simple arrangements, deployment couple 104 may include only a single 1-axis separating hinge, in order to effectively separate and deploy phased array 103 using a single 1-axis motion. In other arrangements, deployment couple 104 may include a single 2-axis primary deployment gimbal only, deploying and orienting phased array 103 in a more complex 2-axis motion.

Similarly, in further arrangements, deployment couples such as couples 104 and 106 may include a combination of a 1-axis separating hinge together with a 2-axis primary deployment gimbal. Using such a deployment couple with both a separating hinge and a primary deployment gimbal, the antenna stowage and deployment system according to one embodiment of the present invention effectuates an initial separation motion (using the 1-axis separating hinge) followed by a deployment maneuver once the phased arrays and/or reflectors have been separated (using the 2-axis primary deployment gimbal). As will be apparent to one of skill in the art, the scope of the present invention is not limited to the particular arrangement of hinges and gimbals described herein, but rather has application to stowage and deployment systems with any combination of hinges, gimbals, or other joints or turning points known to those of skill in the art.

Figure 2B:
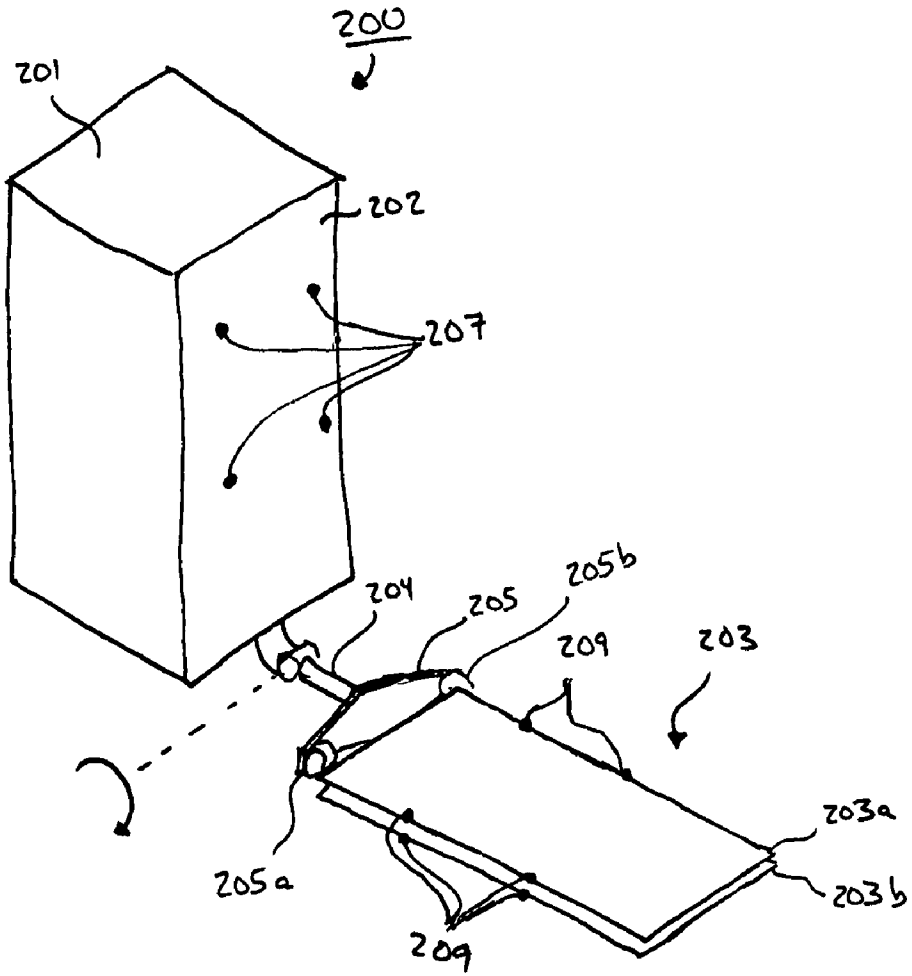
FIGS. 2A to 2D illustrate various states of stowage and deployment of a spacecraft according to one embodiment of the present invention.
Figure 2A:
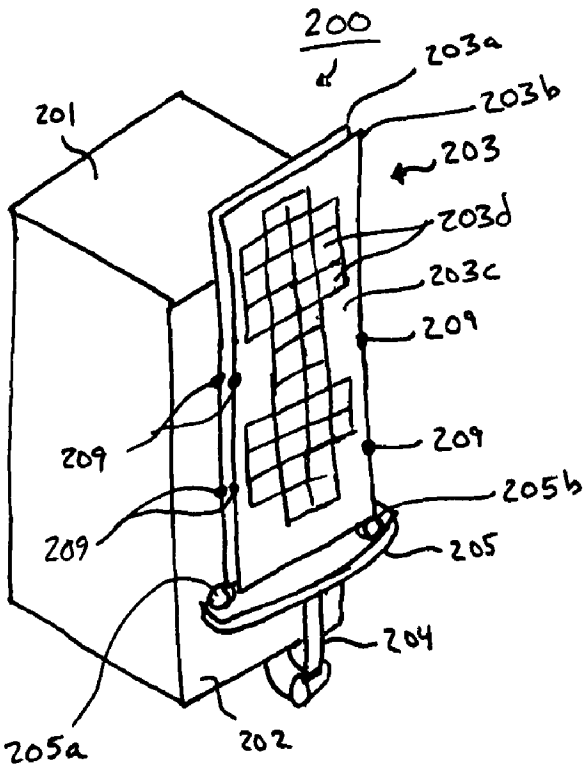

Turning to FIG. 2A, another spacecraft is illustrated in accordance with another embodiment of the present invention, in which two phased array assemblies are coupled to the same side of a spacecraft body. Spacecraft 200 includes spacecraft body 201 with a side 202. Coupled parallel to side 202 (i.e., in the stowed position) of spacecraft body 202 by a deployment couple 204 is a phased array 203, which is made up of phased array assemblies 203*a* and 203*b*. Deployment couple 204 includes 1-axis separating hinge 204*b* for separating phased array 203 from spacecraft body 201. Coupled to deployment couple 204 is a mounting platform 205, to which phased array assemblies 203*a* and 203*b* are coupled by 2-axis primary deployment gimbals 205*a* and 205*b*, respectively. Assembly 203*b* has a face 203*c* on which are disposed a number of elements 203*d*. Face 203*c* is oriented facing away from side 202, to keep elements 203*d* from rubbing against the elements (not shown) of assembly 203*a*. Four launch restraint locations 209 are provided in reflector assembly 203*b* (and four in assembly 203*a*, not all of which are visible in this Figure) for mounting phased array 203 to side 202 of spacecraft body 201, as is illustrated in greater detail with respect to FIG. 2C, below.

Turning to FIG. 2B, spacecraft 200 is seen in a first phase of deployment, in which deployment couple 204 has pivoted mounting platform 205 and phased array 203 away from side 202 of spacecraft body 201. In this view, the common launch restraint mounting points 207 which assemblies 203*a* and 203*b* share can be seen on side 202 of spacecraft body 201. Also visible are additional launch restraint locations 209 in assembly 203*a*, the back side of which (i.e., the side without elements) is visible at this phase.

Figure 2C:
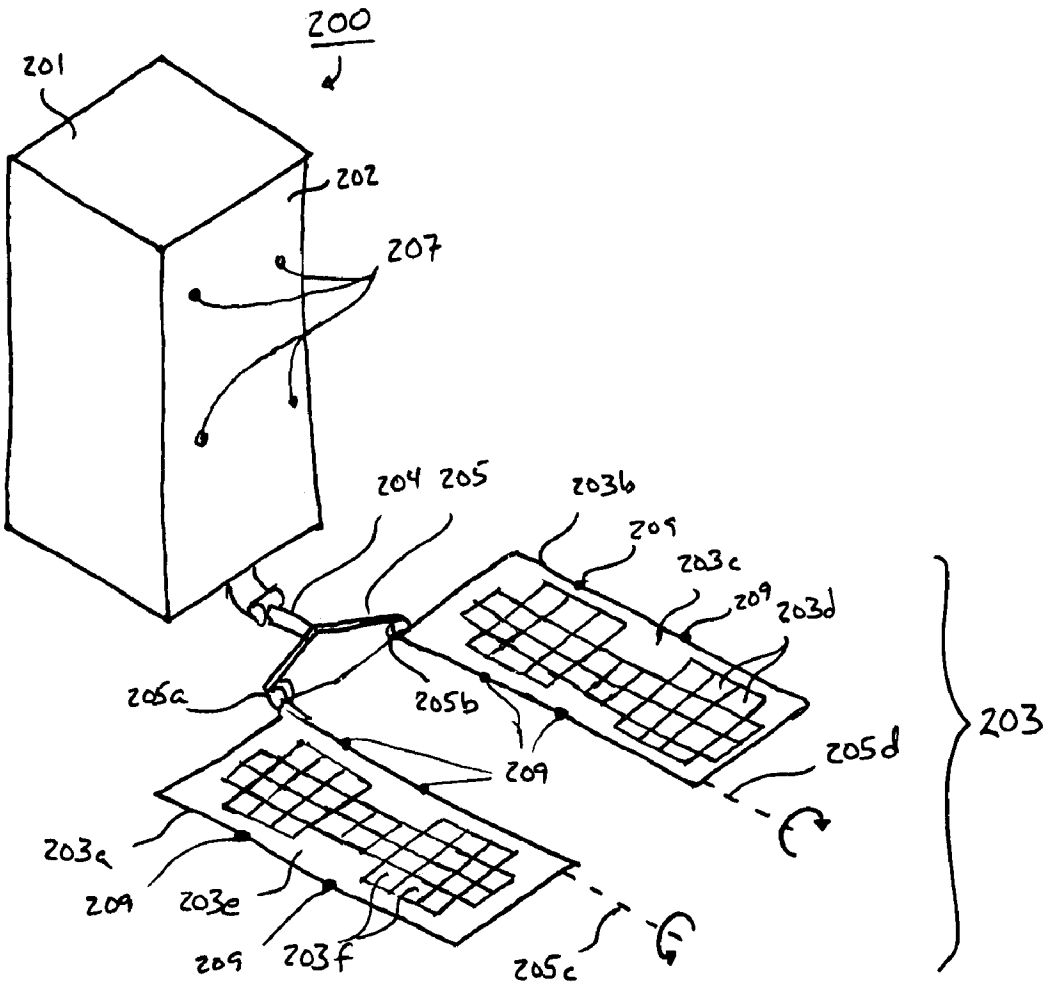

Turning next to FIG. 2C, spacecraft 200 is seen an another phase of deployment, in which primary deployment gimbals 205*a* and 205*b* have rotated assemblies 203*a* and 203*b*, respectively, around axes 205*c* and 205*d* (which are parallel to an axis of deployment couple 204) through an angle of 180°. In the present exemplary embodiment, assembly 203*a* has been rotated 180° counter-clockwise, while assembly 203*b* has been rotated 180° in a clockwise direction. Visible in this Figure is the face 203*e* of assembly 203*a*, on which are disposed elements 203*f*. As can be seen with reference to FIGS. 2A to 2C, deployment couple 204, mounting platform 205 and primary deployment gimbals 205*a* and 205*b* permit phased array assemblies 203*a* and 203*b* to be stored with their faces 203*e* and 203*c* commonly oriented (e.g., in the present example, oriented facing away from side 202 of spacecraft body 201).

Figure 2D:
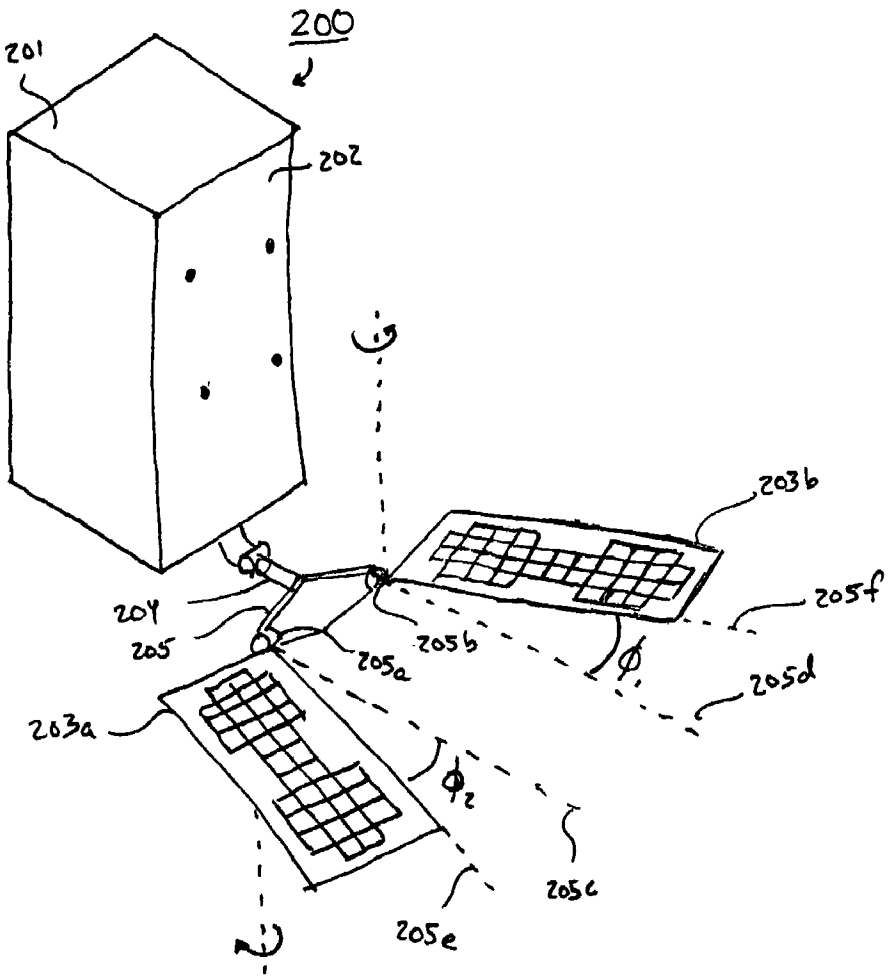

FIG. 2D illustrates spacecraft 200 enjoying yet another advantage of a mounting system according to one embodiment of the present invention. As can be seen with reference to FIG. 2D, mounting platform 205 and primary deployment gimbals 205*a* and 205*b* are configured to permit phased array assemblies 203*a* and 203*b* to lie in a single plane and be rotated to have different axes of orientation, in a manner similar to that illustrated in FIG. 1B with respect to reflector 105 and phased array 103. 2-axis primary deployment gimbal 205*a* is configured to rotate phased array assembly 203*a* over an angle of $\Phi_2$ such that the axis of orientation of phased array assembly 203*a* changes from axis 205*c* to axis 205*e*. Similarly, 2-axis primary deployment gimbal 205*b* is configured to rotate phased array assembly 203*b* over an angle of $\Phi_1$ such that the axis of orientation of phased array assembly 203*b* changes from axis 205*d* to axis 205*f*. In this manner, phased array assemblies 203*a* and 203*b* can be can be separated upon deployment and, when provided with independent pointing systems (e.g., motor assemblies or other actuators for moving phased array assemblies with respect to mounting platform 205), phased array assemblies 203*a* and 203*b* can be steered separately.

While the foregoing exemplary embodiment has been described with reference to the faces of multiple phased array assemblies all pointing away from the side of a spacecraft body when stowed, the scope of the present invention is not limited to such an arrangement. Rather, as will be apparent to one of skill in the art, the present invention has application to arrangements in which the faces of multiple phased array assemblies all point towards the side of a spacecraft body when stowed, or arrangements in which the faces of multiple phased array assemblies point in different directions when stowed.

Similarly, while the foregoing exemplary embodiments have been described with reference to phased arrays and phased array assemblies having only one face with elements, the scope of the present invention is not limited to such an arrangement. Rather, as will be apparent to one of skill in the art, the present invention has application to arrangements in which phased arrays are provided with elements on more than one face.

Moreover, while the foregoing exemplary embodiment has been described with reference to a single phased arrays mounted to a single side of a spacecraft body, the scope of the present invention is not limited to such an arrangement. Rather, as will be apparent to one of skill in the art, the present invention has application to arrangements in which multiple phased arrays are provided one more than one side of a spacecraft body.

Figure 3B:
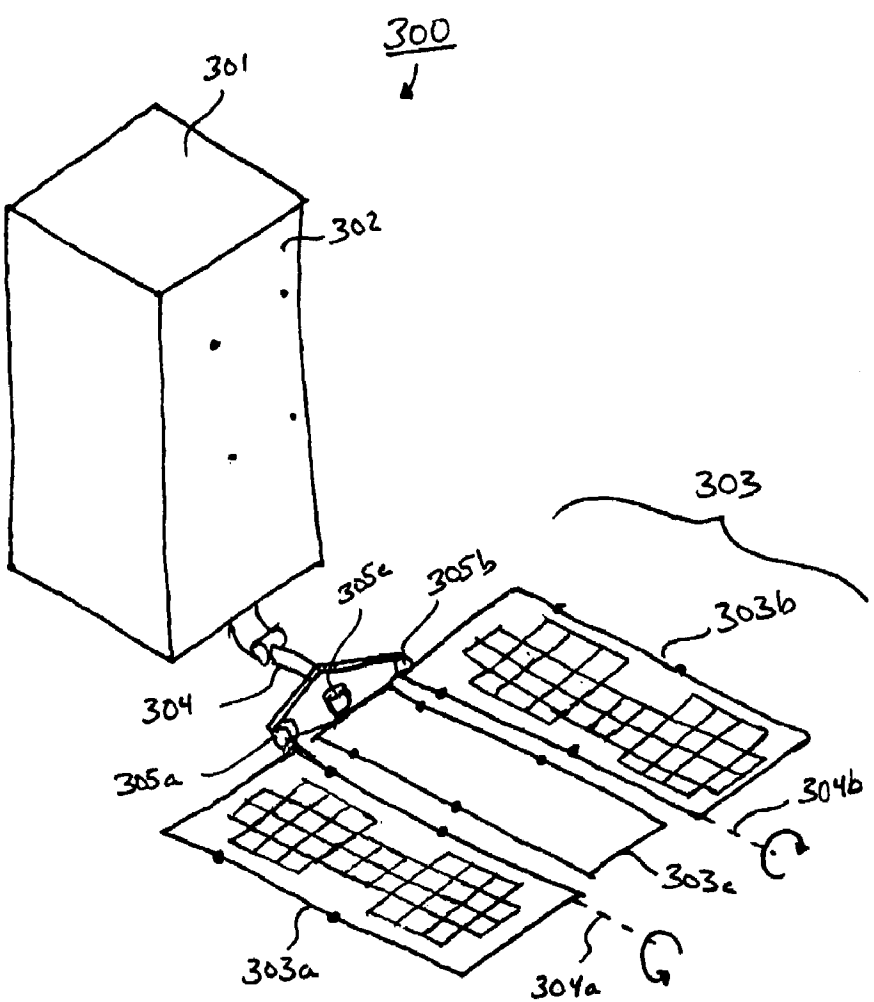
FIGS. 3A to 3C illustrate stowed and deployed states of a spacecraft according to one embodiment of the present invention.
Figure 3A:
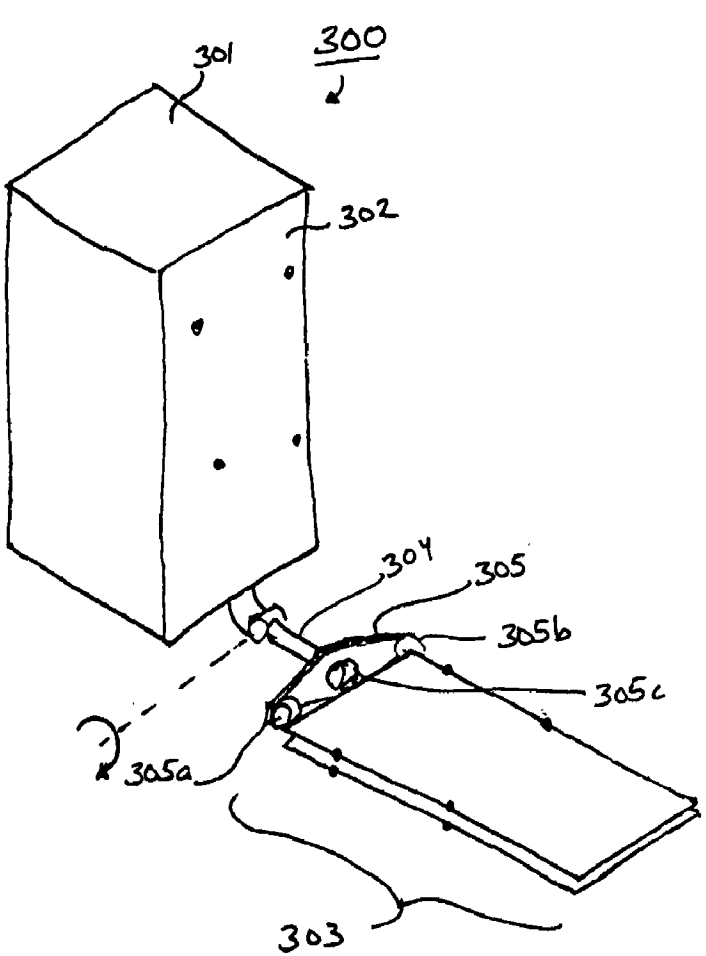
Figure 3C:
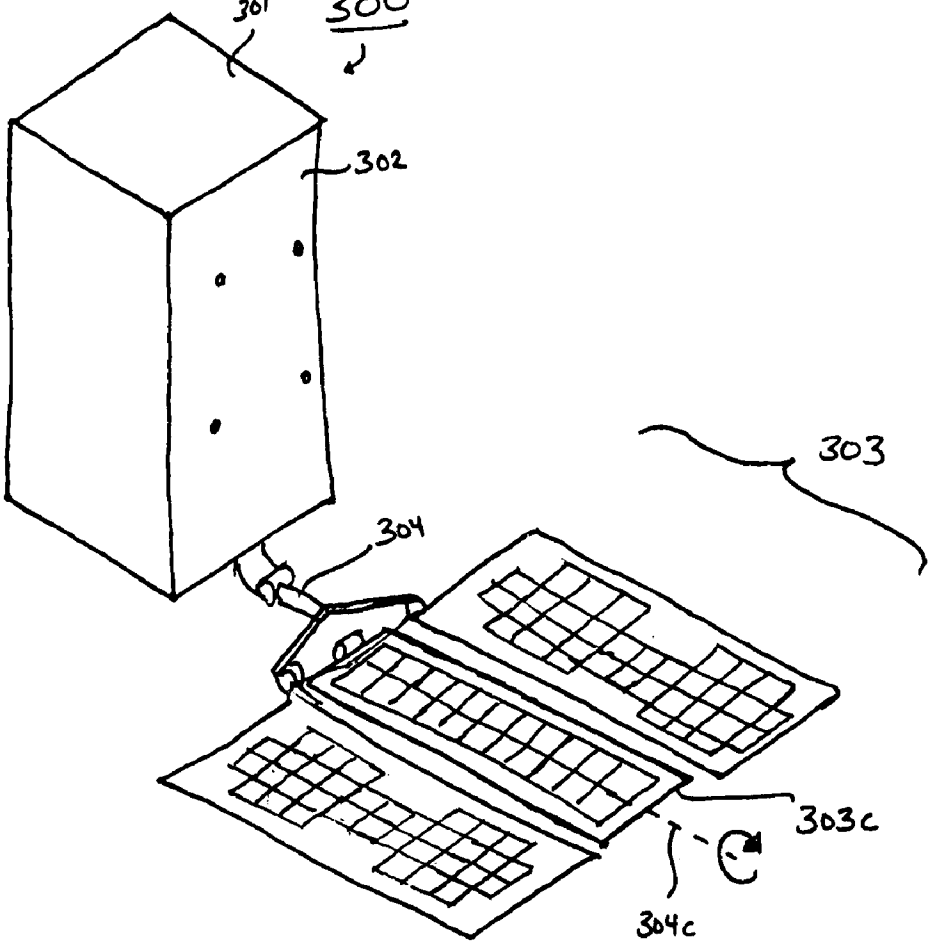

FIGS. 3A to 3C illustrate a spacecraft in accordance with another embodiment of the present invention, in which three phased array assemblies are coupled to the same side of a spacecraft body by a single deployment couple and a single mounting platform. Turning to FIG. 3A, spacecraft 300 includes spacecraft body 301 with a side 302. Coupled to side 302 (i.e., here illustrated in a partially deployed position) of spacecraft body 302 by a deployment couple 304 is a phased array 3, which is made up of three phased array assemblies. Attached to deployment couple 304 is a mounting platform 305, to which the three phased array assemblies are coupled by 2-axis primary deployment gimbals 305*a*, 305*b* and 305*c*.

Turning to FIG. 3B, spacecraft 300 is illustrated with phased array 303 in the next step of deployment, in which phased array assemblies 303*a* and 303*b* have been rotated by gimbals 305*a* and 305*b*, respectively, through 180° about axes 304*a* and 304*b* (which are parallel to an axis of deployment couple 304). In FIG. 3C, spacecraft 300 is illustrated with phased array 300 in a fully-deployed state, with phased array assembly 303*c* having been rotated through 180° about axis 304*c*, which is parallel to an axis of deployment couple 304 (e.g., an axis defined at least in part by a direction in which a portion of deployment couple 304 is pointing).

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A spacecraft comprising:

a spacecraft body;

a first phased array coupled to a first side of the spacecraft body;

a first reflector coupled to the first side of the spacecraft body;

a first deployment couple disposed between the first phased array and the first side of the spacecraft body and coupled to the first phased array and the first side of the spacecraft body, the first deployment couple configured to permit stowing the first phased array parallel to the first side of the spacecraft body;

a second deployment couple disposed between the first reflector and the first side of the spacecraft body and coupled to the first reflector and the first side of the spacecraft body, the second deployment couple configured to permit stowing the first reflector parallel to the first side of the spacecraft body; and a first common launch restraint system configured to secure the first phased array and the first reflector to the first side of the spacecraft body using at least one common launch restraint mounting point.

2. The spacecraft of claim 1, wherein the first deployment couple and the second deployment couple are configured to permit stowing the first reflector on top of the first phased array.

3. The spacecraft of claim 1, wherein the first phased array and the first reflector each include one or more launch restraint locations for securing the first phased array and the first reflector to the common launch restraint mounting point.

4. The spacecraft of claim 1, wherein the first phased array has a face with a plurality of elements, and wherein the first deployment couple includes a gimbal configured to permit stowing the first phased array parallel to the first side of the spacecraft body and with the face of the first phased array oriented away from the first side of the spacecraft body.

5. The spacecraft of claim 4, wherein the gimbal is configured to permit rotating the first phased array around an axis of the first deployment couple through an angle of at least 180°.

6. The spacecraft of claim 1, wherein the first phased array comprises a plurality of phased array assemblies, wherein each of the plurality of phased array assemblies are coupled to a mounting platform by a gimbal, and wherein the mounting platform is coupled to the first deployment couple.

7. The spacecraft of claim 6, wherein each of the plurality of phased array assemblies has a face with a plurality of elements, and wherein the first deployment couple and the gimbals of the plurality of phased array assemblies are configured to permit stowing the plurality of phased array assemblies parallel to the first side of the spacecraft body and with the face of each of the plurality of phased array assemblies oriented in a first direction.

8. The spacecraft of claim 6, wherein at least one of the plurality of gimbals is configured to permit rotating an associated phased array assembly around an axis parallel to an axis of the first deployment couple through an angle of at least 180°.

9. The spacecraft of claim 6, wherein at least one of the plurality of gimbals is a 2-axis gimbal configured to permit deploying an associated phased array assembly in a same plane as another one of the plurality of phased array assemblies and with a different axis of orientation as the other one of the plurality of phased array assemblies.

10. The spacecraft of claim 1, wherein the second deployment couple includes a 2-axis gimbal configured to permit deploying the first reflector in a same plane as the first phased array and with a different axis of orientation as the first phased array.

11. The spacecraft of claim 1, further comprising:

a second phased array coupled to a second side of the spacecraft body;

a second reflector coupled to the second side of the spacecraft body;

a third deployment couple disposed between the second phased array and the second side of the spacecraft body and coupled to the second phased array and the second side of the spacecraft body, the third deployment couple configured to permit stowing the second phased array parallel to the second side of the spacecraft body;

a fourth deployment couple disposed between the second reflector and the second side of the spacecraft body and coupled to the second reflector and the second side of the spacecraft body, the fourth deployment couple configured to permit stowing the second reflector parallel to the second side of the spacecraft body; and a second common launch restraint system configured to secure the second phased array and the second reflector to the second side of the spacecraft body using a second at least one common launch restraint mounting point.

12. The spacecraft of claim 11, wherein the first side of the spacecraft body and the second side of the spacecraft body are opposite one another.

13. A spacecraft comprising:

a spacecraft body;

a first mounting platform coupled to a first side of the spacecraft body;

a first deployment couple disposed between the first mounting platform and the first side of the spacecraft body and coupled to the first mounting platform and the first side of the spacecraft body;

a first plurality of phased array assemblies, each of the first plurality of phased array assemblies having a face with a plurality of elements, each of the first plurality of phased array assemblies being coupled to the first mounting platform by a gimbal; and a first common launch restraint system configured to secure the first plurality of phased array assemblies to the first side of the spacecraft body using at least one common launch restraint mounting point, wherein the first deployment couple and the first plurality of gimbals are configured to permit stowing the first plurality of phased array assemblies parallel to the first side of the spacecraft body and with the face of each of the first plurality of phased array assemblies oriented in a first direction.

14. The spacecraft of claim 13, wherein at least one of the plurality of gimbals is configured to permit rotating an associated phased array assembly around an axis parallel to an axis of the first deployment couple through an angle of at least 180°.

15. The spacecraft of claim 13, wherein at least one of the plurality of gimbals is a 2-axis gimbal configured to permit deploying an associated phased array assembly in a same plane as another one of the plurality of phased array assemblies and with a different axis of orientation as the other one of the plurality of phased array assemblies.

16. The spacecraft of claim 15, further comprising a plurality of motor assemblies corresponding to the plurality of phased array assemblies, each motor assembly being configured to independently steer a corresponding phased array assembly.

17. The spacecraft of claim 13, further comprising:

a second mounting platform coupled to a second side of the spacecraft body;

a second deployment couple disposed between the second mounting platform and the second side of the spacecraft body and coupled to the second mounting platform and the second side of the spacecraft body;

a second plurality of phased array assemblies, each of the second plurality of phased array assemblies having a face with a plurality of elements, each of the second plurality of phased array assemblies being coupled to the second mounting platform by a gimbal; and a second common launch restraint system configured to secure the second plurality of phased array assemblies to the second side of the spacecraft body using at least one common launch restraint mounting point, wherein the second deployment couple and the second plurality of gimbals are configured to permit stowing the second plurality of phased array assemblies parallel to the second side of the spacecraft body and with the face of each of the second plurality of phased array assemblies oriented in a second direction.

18. The spacecraft of claim 17, wherein the first side of the spacecraft body and the second side of the spacecraft body are opposite one another.

19. The spacecraft of claim 13, wherein each of the first plurality of phased array assemblies includes one or more launch restraint locations for mounting the first plurality of phased array assemblies to the common launch restraint mounting point with a launch restraint system.

20. The spacecraft of claim 13, further comprising a reflector coupled to the first side of the spacecraft body by a second deployment couple.

21. The spacecraft of claim 20, wherein the reflector shares the first common launch restraint mounting point with the first plurality of phased array assemblies.

* * * * *